US006745991B1

(12) United States Patent
Rush

(10) Patent No.: US 6,745,991 B1
(45) Date of Patent: Jun. 8, 2004

(54) DECORATIVE TREE STAND

(75) Inventor: Hugh S. Rush, Quaker town, PA (US)

(73) Assignee: Tree Teck Inc., Haven, PA (US)

( * ) Notice: Subject to any disclaimer, the term of this patent is extended or adjusted under 35 U.S.C. 154(b) by 0 days.

(21) Appl. No.: 10/387,594

(22) Filed: Mar. 14, 2003

(51) Int. Cl.[7] ..... F16M 13/00
(52) U.S. Cl. ..... 248/523; 248/903; 47/40.5
(58) Field of Search ..... 248/523, 519, 248/526, 524, 525, 527, 903; 47/40.5

(56) References Cited

U.S. PATENT DOCUMENTS

| | | | | | |
|---|---|---|---|---|---|
| 3,862,733 | A | | 1/1975 | Sullivan | 248/48 |
| 4,126,963 | A | * | 11/1978 | Dunbar | 47/40.5 |
| 4,159,096 | A | | 6/1979 | Chase | 248/523 |
| 5,014,461 | A | | 5/1991 | Braucke | 47/40.5 |
| 5,121,897 | A | * | 6/1992 | Sofy | 248/527 |
| 5,580,026 | A | * | 12/1996 | Newcomer | 248/523 |
| 6,070,848 | A | * | 6/2000 | Ogren | 248/523 |
| 6,286,804 | B1 | * | 9/2001 | Avinger | 248/523 |

* cited by examiner

*Primary Examiner*—Gwendolyn Baxter
(74) *Attorney, Agent, or Firm*—A. R. Eglington

(57) ABSTRACT

A portable tree stand has a lower surface adapted for resting on a substantially level plane and an upper surface comprising a bowl-shaped depression provided with an upstanding rigid pin assembly being located in the bowl depression, with the pin assembly being integral of a central platform component of the bowl inner surface. The sidewalls of the stand extend radially outward to the lower most periphery thereof and present an external conical frustum skirt.

8 Claims, 4 Drawing Sheets

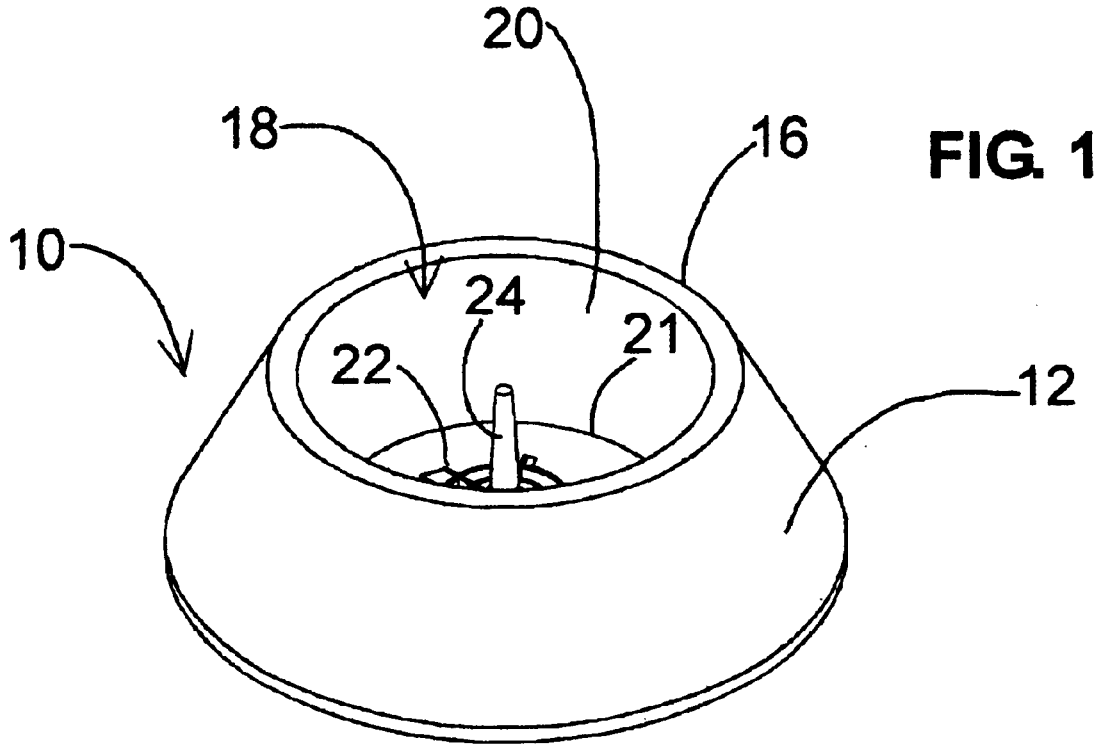
FIG. 1
FIG. 2
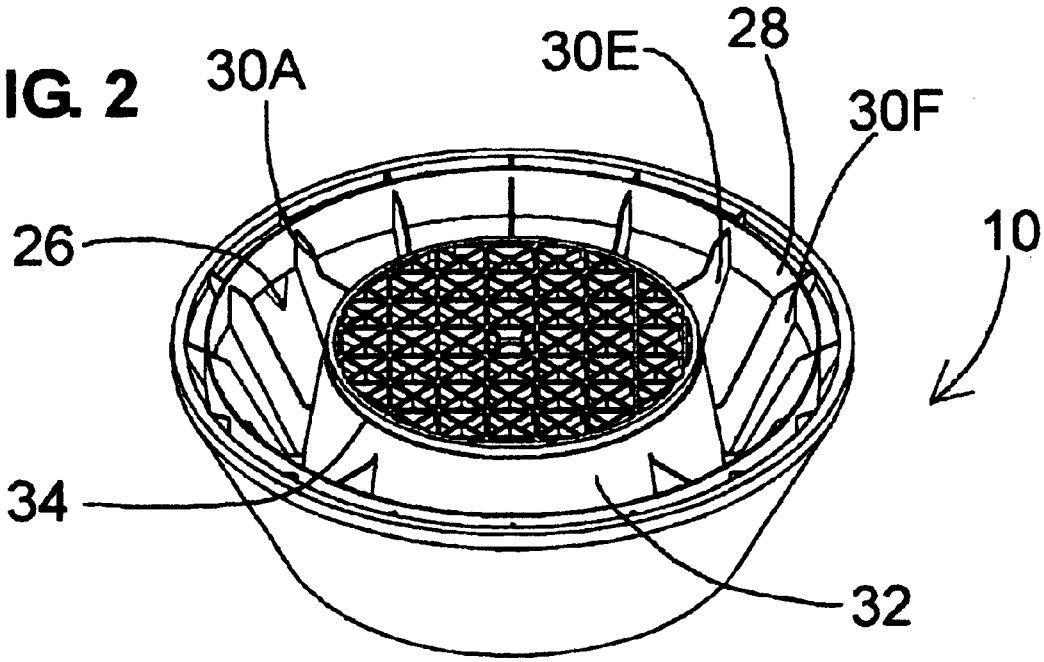

FIG. 3
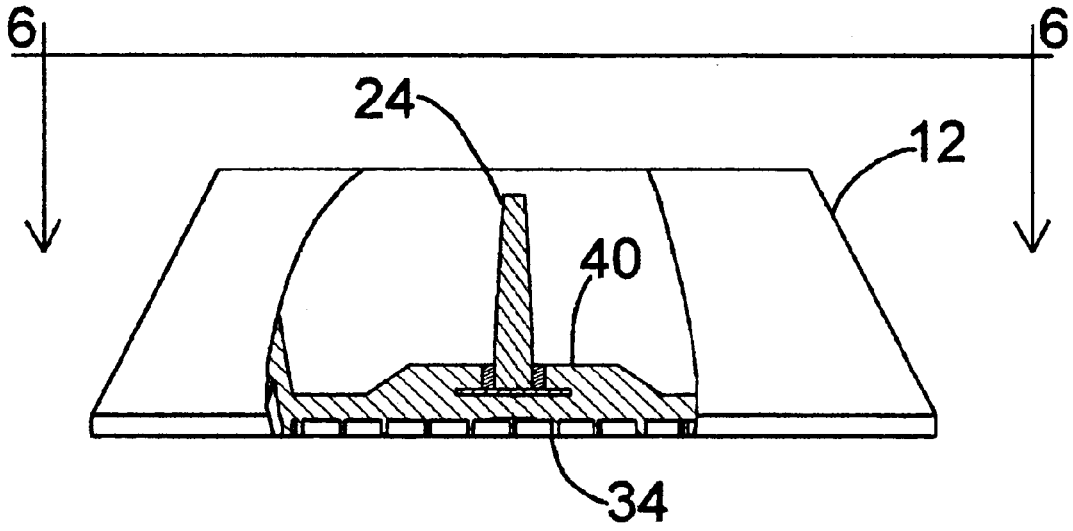
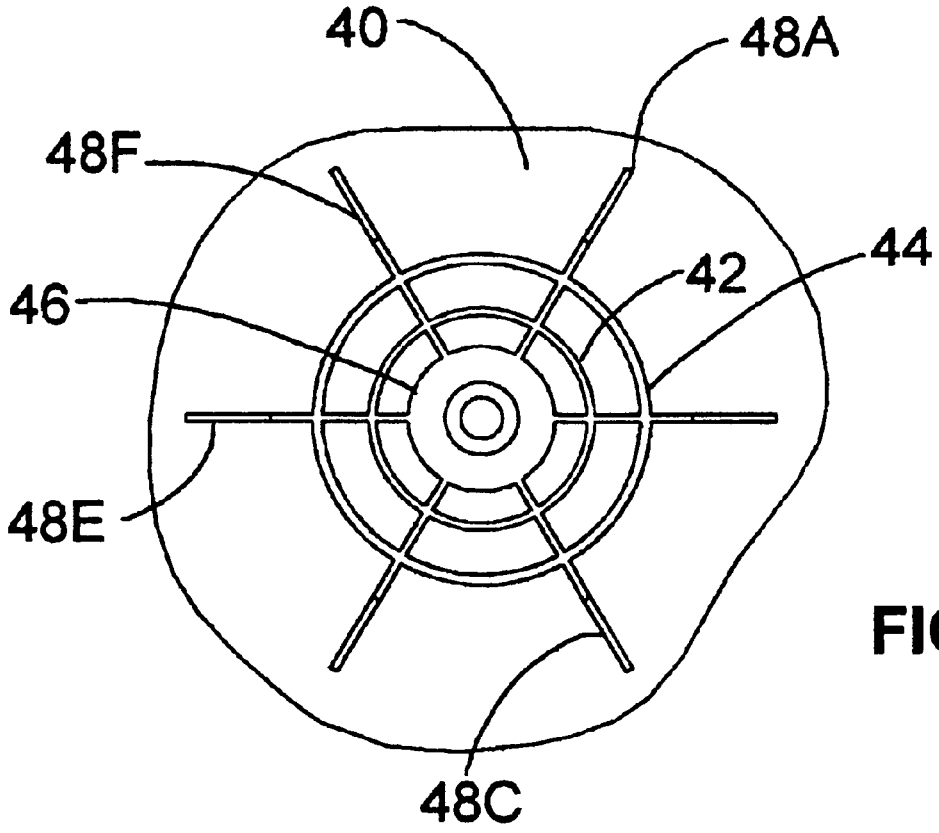
FIG. 4

FIG. 8
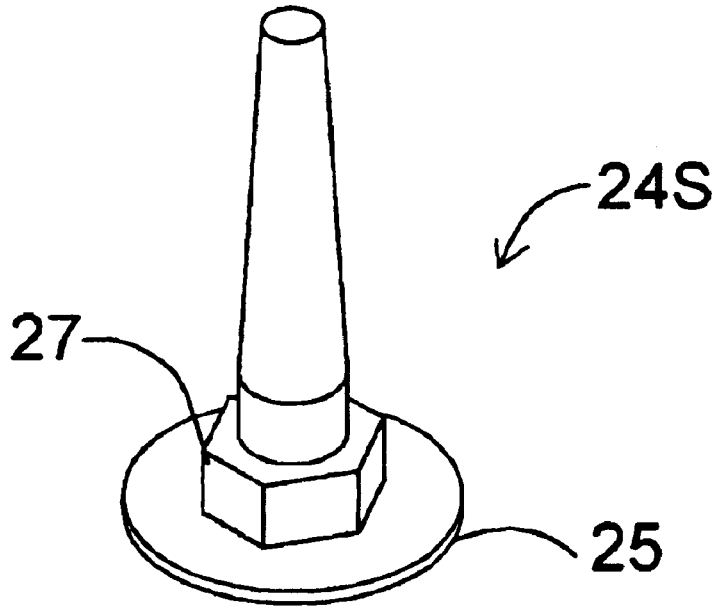
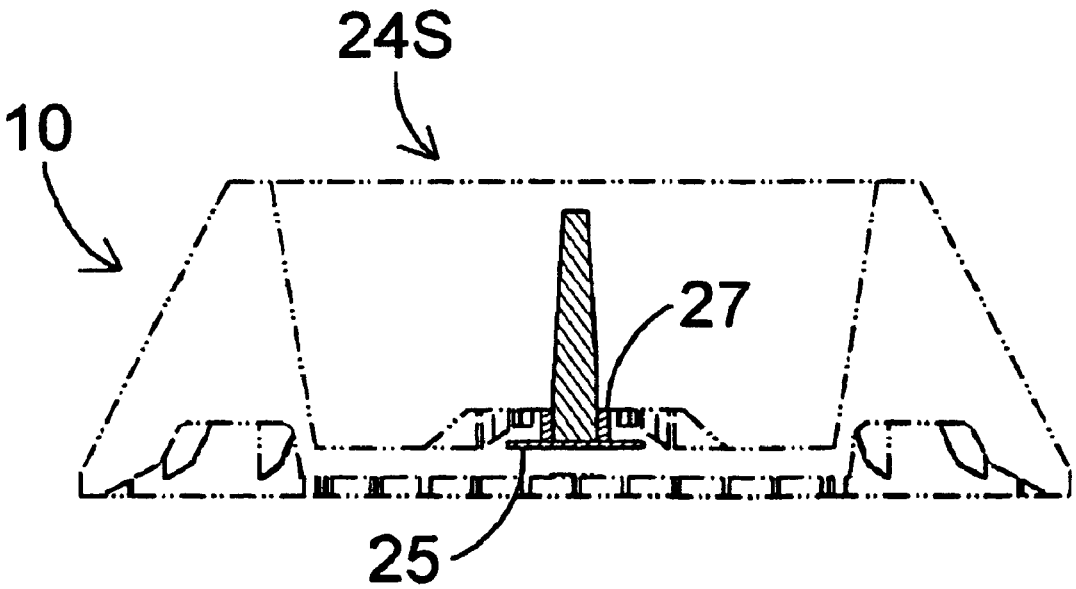
FIG. 9

DECORATIVE TREE STAND

CROSS-REFERENCE TO OTHER APPLICATIONS

None.

BACKGROUND OF THE INVENTION

Load bearing stands, especially suitable for Christmas trees, and the like, have long been known. One of the principal problems in the fabrication of such stands has been that of producing the strongest possible stand, from a load support viewpoint, in the simplest and cheapest manner. Heretofore, stands made using stamped, sheet metal components were particularly common.

More recently, stands fabricated of molded plastic have become commercially significant. As a constructional material, plastic has much different properties from sheet metal, but usually the cheaper plastics have lower strength than, say, sheet steel. On the other hand, complex shapes can be produced more easily, sometimes in a singe forming operation, using a thermoplastic.

Molded plastic stands heretofore have not always been strong, and frequently have been too expensive for the popular markets. Also, most Christmas tree stands require multiple components to arrive at a stable stand for an invariably top-heavy tree trunk, and further to provide a water reservoir from which the tree trunk can draw needed moisture.

The load bearing stand of Sullivan U.S. Pat. No. 3,862, 733 (January/1975) has a shallow base and a plurality of demountable legs, such that the legs interlock and cooperate with the base member to permit the assembled stand to support a relatively far greater weight.

The tree stand of Ascher U.S. Pat. No. 4,159,096 (June/1979) discloses a central, disc-shaped portion, which interlocks vertically and horizontally with a plurality of radiating tapered legs, plus requiring the molding of components from thermoplastic resin materials, and further including complex tongue and groove arrangements for leg and base assemblies;

The stand of Brauckhe U.S. Pat. No. 5,014,461 (May/1991) includes an upright tubular portion adapted to receive the tree stump, and with at least three support legs being slot-joined to the tubular portion. Also needed are upper and lower sets of circumferentially spaced, threaded fasteners disposed on two spaced apart, horizontal planes. The stand is produced in the form of a die cast of injection molded main body necessarily with separately molded or die cast sets of support legs.

Complicated mold configurations, with tight tolerances are needed for facile assembly of components, in each of the aforedescribed tree stands.

The art continues to seek new and improved constructions and techniques adapted for the manufacture of lightweight, strong economical plastic stands.

It should be apparent that the operable stands of the exemplified patents call for plural parts, fastener accessories, and inescapably careful user assembly, in order to yield a useful stand that will not be toppable with a tree load imposed upon it.

It is a principal object of the present invention to provide a stable, load bearing stand, which is well adapted for Christmas tree mounting and moisture maintenance.

Another object of the present invention is to provide a load bearing stand as an integral article needing no metal accessories beyond the one mounting pin, and avoiding the chore of ensuring proper assembly by the user before tree mounting.

A still further object of the invention is to provide a single-piece tree stand having an adequately heavy base and a reservoir for tree moisturizing.

A yet further object of the invention is to provide a stand with an underside surface adapted to provide for added frictional engagement with the support platform.

Other objects and advantages of this invention will be apparent from the following specification, accompanying drawings, and appended claims.

SUMMARY OF THE INVENTION

A very strong, very stable, and non-assembly tree stand is provided for Christmas trees, and the like, which stand is so configured that it increases its stability in relation to the load applied to the stand in the form of a tree decorations. The stand also includes a central hub, or conical disc-shaped body portion which is made together with a mounting pin to form a rigid support means a one-piece, molded body with the upper surface thereof, having a centrally defined, bowl-shaped depression (recessed) encompassed with an uppermost circular rim; an upstanding rigid pin anchored substantially centrally of the depression and being adapted to receive the lower end of a trunk, and which is ensconceable thereupon; the sidewalls of the body extending radially outward from the circular rim thereof to a peripheral portion of the lower surface thereof, thus presenting an external truncated conical skirt; a generally planar, bottom plate located centrally of, and integral with, the stand lower surface, the plate being adapted to make frictional contact with an underlying platform, and the bottom plate being further provided with a plurality of diagonally-oriented generally linear, ribs that enhance the degree of frictional contact between the stand lower surface and the underlying platform.

BRIEF DESCRIPTION OF THE DRAWING

The objects and advantages of the invention will become apparent from the following detailed description of a preferred embodiment thereof in connection with the accompanying drawings, in which like numbers designate like elements, and in which:

FIG. 1 is a top side perspective view illustrating a preferred embodiment of the tree stand of the present invention depicting its frustro-conical outer skirt;

FIG. 2 is a bottom-side perspective view depicting the underlying configuration of the tree stand of FIG. 1;

FIG. 3 is a side elevational view of the tree stand of the present invention, partially broken away depicting the internal configuration of the tree stand of FIG. 1.

FIG. 4 is a broken away, enlarged top plan view of the bowl central platform of the stand of FIG. 1;

FIG. 8 is a perspective view of the isolated central pin assembly mountable on the bowl central platform; and FIG. 9 is a side elevational view of the central pin in situ, with the associated tree stand shown in phantom.

DETAILED DESCRIPTION OF A PREFERRED EMBODIMENT

Figure 5:
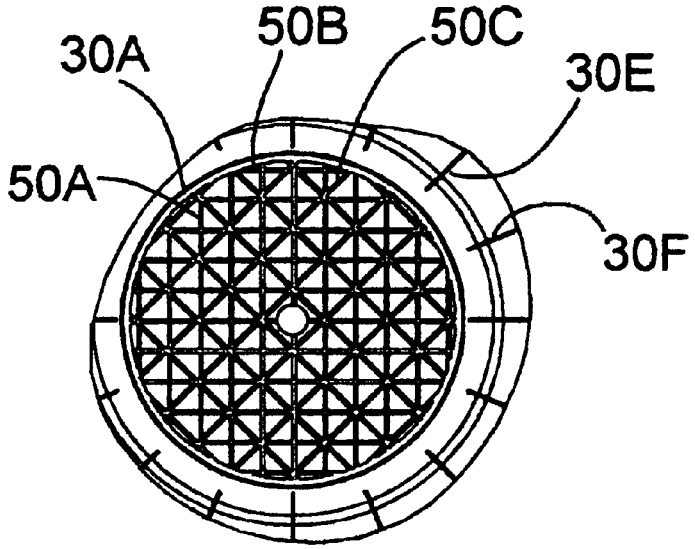
FIG. 5 is a broken away, enlarged bottom plan view of the downwardly projecting cross-hatched, centered platform of the stand of FIG. 1.

Referring now to the drawing in which like reference numeral refer to like parts throughout the several views thereof, an improved, super stable, assembled free tree stand, generally designated 10, is shown in FIG. 1.

Stand 10 comprises a generally circular periphery article having an upwardly tapering conical frustum skirt 12, the lower circular periphery 14 of which provides a stable platform for the stand. The upper circular periphery, or rim, 16 defines an enlarged, concentrically aligned, bowl-shaped depression 18, which is encompassed by that rim 16.

The circular sidewall of depression 20 is substantially vertical, and conjoining along seam 21 with a substantially planar bottom surface 22 of the bowl. Centrally located in the bowl 18 is an upstanding rigid pin 24, preferrably tapered upwardly, and adapted to receive the cut or butt end of a decorative tree (not shown). Prior to stand mating with the tree, a conical hole is drilled into the cut trunk of the tree, providing the preferably tapered bore in the tree trunk cut end.

Looking now to FIG. 2, the bottom-side view of stand 10 is seen. A generally hollow underchamber 26 of the stand is to be noted. The underside tapered sidewall 28 is provided with a plurality of spaced apart, radially oriented, integrated ribs 30A,B,C, etc., which serve as an inner reinforcement for skirt. They interconnect with the external surface 32, of the cylindrically shaped, bowl 18 of the stand 10. A set of radial ribs are integral along their vertical edges with the opposing outer skirt and the bowl sidewall 28. Concentrically aligned on the bowl bottom 22 is a substantially horizontal, planar base 34, the circular surface of which is coincident with the lower edge periphery 14, as to their vertical heights.

Planar base 34 is provided with a large plurality of diagonally-oriented, cross-hatched generally linear ribs, which are best seen in FIG. 5 as 50A, 50B, and 50C, which serve to enhance the degree of frictional contact between the stand bottom plate 34 and the underlying floor surface (not seen), on which the stand 10 is positioned for tree mounting.

In the partly sectional side elevation view of FIG. 3, certain of the internal bowl components are seen: outer tapered skirt 12, for bowl 18, pin 24, a disk shaped, second platform 40 for the pin-mounted, cut end tree trunk (not seen), and the ribbed bottom base 34. Tree butt is pressure-fitted on central pin 24.

The broken away, enlarged top view of FIG. 4 shows the configuration of inner stump platform 40 being disposed concentrically of the open bowl 18 of the stand 10. At least two concentric circular ribs, 42 and 44, are disposed concentrically of mounting knob 46. Upright pin 24 is fixedly secured upstanding upon knob 46. Another concentric circular rib may be provided (not shown). To enhance base rigidity and tree end contact, several radial ribs 48A–F extending from hub 46, are imposed intersecting on circular ring ribs 42 and 44. They are conveniently beveled at their outermost edges (FIG. 3) to avoid sharp corners for the stand user.

In the broken out, underview of base plate 34 of FIG. 5, there is seen: the large plurality of diagonally oriented, intersecting linear ribs, 50 A,B, and C, which enhance the degree of underlying stand frictional contact with the support surface. These ribbings are molded integral with the outer surface of planar bottom 22 of the stand bowl 14. Spaced apart, radial ribs, like 30A, also interconnect the bowl sidewall 38 with the inner tapered, frustum-conical surface 38 of the bowl skirt 12.

Figure 6:
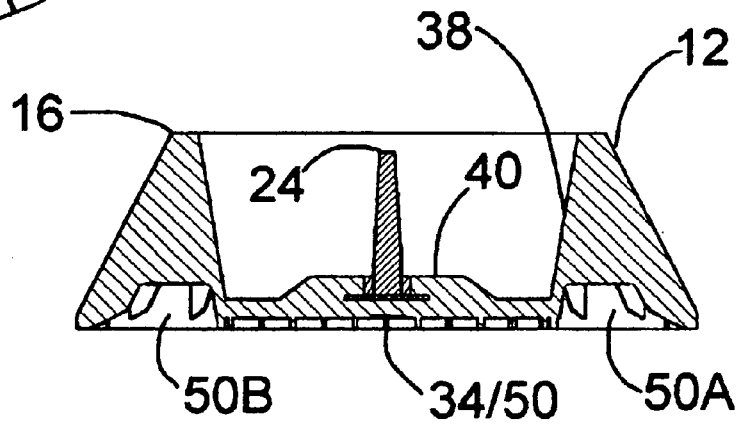
FIG. 6 is a full vertical sectional view of the present stand, taking along lines 6—6 of the side elevation view of FIG. 3.

In the vertical sectional view of FIG. 6, taken along line 6—6 of FIG. 3, the bowl components are better seen, including: center platform 40, erect rigid pin 24 anchored therein, as by tapping and/or welding into the knob; substantially vertical, opposing inner sidewalls 38 of the bowl 20; open annulus 52 disposed between the outer skirt 12 and the bowl sidewall; and the underside pattern of diagonally disposed ribbing 50, which presents the cross-hatched pattern seen in the detail of FIG. 5.

Figure 7:
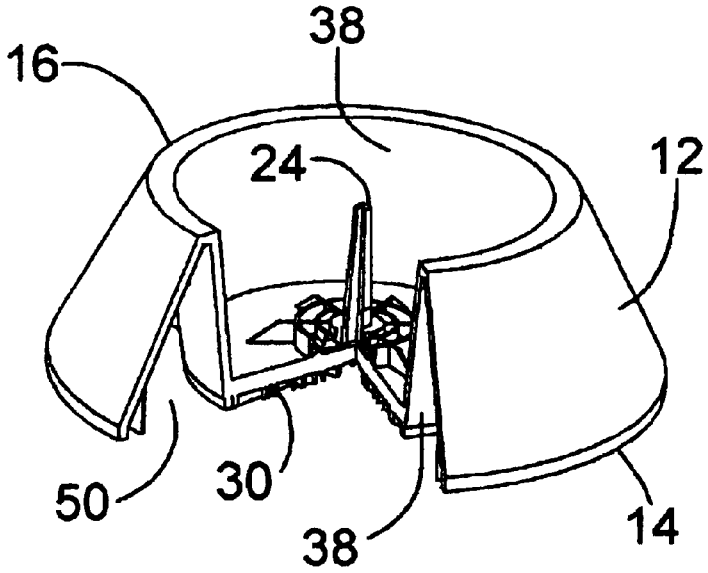
FIG. 7 is a perspective view, with a pie-shaped segment broken out, to better depict the bowel portion of the preferred embodiment.

In the perspective view of FIG. 7, having a pie-shaped segment cut away, the operative components are seen in their juxtaposition. Lower circular periphery rim 14, along with central ribbed base 34, (FIG. 5), provides support surface contact, when the stand is positioned for tree mounting, as in FIG. 2. The inverted V-shaped vertical cross-section of the skirt and opposing sidewall present an underside annulus 50, which hollow space serves to reduce the weight of the stand, and to economize upon the elastomer cost to produce the molded stand. The aforedescribed optional, ribbed central platform 40 about the base knob 46 (FIG. 4) is for the conjoining with the tree cut end (not seen).

A pin subassembly, generally 24S, is fabricated from cold 1018 steel stock, including its depicted taper. It also has a lower end, circular flanged plate element 25. This flange results in permanent anchoring of the tree-loaded support pin integral with central base platform 40. The assembly 24S is fabricated separately, and is then inserted and positioned within the injection mold cavity, being so positioned so as to permit the fluid resin to flow into the mold cavity (not seen) and to produce the fixed in-place pin assembly 24 of FIG. 1. The pin is then adapted to rigidly support the cut tree stump(not seen), even when being stressed by virtue of the forced torsional mounting of the tree stump on central pin 24. The injection molding techniques, and the incorporating of a separate subassembly such as 24S, are well known to those in the art of articles of fabrication from multiple resins.

In the partially phantom view of FIG. 9, as to the integral stand itself, the second juxtaposition of pin 24 with bottom flange 25 and sealing ring 27 are seen in the vertical cross sectional view of FIG. 9.

The stand is produced advantageously in the form of a die cast, or injected molded, part. For a production as a die cast part, the known die casting alloys, in particular, those used in the making of light metals may be used. Preferably, it is practical to produce the stand in the form of an injection molded part, or in the plastic to be used may be chosen in keeping with the structural requirements. Fiber reinforced plastics are suitable for highly stressed parts. It has been established also that a polyolefin, like linear polyethylene, or polypropylene, or polyvinyl chloride formed polymer, are all well suited materials of fabrication. Linear polypropylene (Marlex® resin) is an especially suitable material of construction. They provide both light weight for the finished article, and an economy of cost in the injection molding embodiment of the present article and invention.

What is claimed is:

1. A portable stand adapted for supporting a trunk of a large plant and tree on an upper surface thereof, and having a lower surface suitable for resting on a substantially level, underlying first platform comprising:

(a) a one-piece, molded body with the upper surface thereof, having a centrally aligned, bowl-shaped depression which is encompassed with an uppermost circular rim;

(b) an upstanding rigid pin with upper and lower longitudinal ends, with the lower end being anchored substantially centrally of the depression and being adapted to receive the lower end of a tree trunk, and which trunk is ensconceable thereupon;

(c) the outer sidewalls of the body extending radially outward from the uppermost rim thereof to a lowermost peripheral rim of the lower surface thereof, thus presenting an external truncated conical frustum configured skirt;

(d) a generally planar, bottom plate located centrally of, and integral with, the stand lower surface, the plate being adapted to make frictional contact with an underlying first platform, said bottom plate being further provided with a plurality of diagonally-oriented, generally linear, ribs that enhance the degree of frictional contact between the stand lower surface and the underlying first platform, and, (e) in which the underlying surface of the conical frustrum-configured skirt is provided with a plurality of vertically oriented, and radially aligned, integral ribs which are circumferentially spaced about the skirt surface that serve to reinforce the rigidity of the stand sidewalls.

2. The stand of claim 1 wherein the depression is of a depth sufficient to provide a water receptacle serving to feed contained moisture to the lower end of the supported trunk.

3. The stand of claim 1 wherein the bowl-shaped depression is provided with an integral, disk-shaped, second platform underlying the rigid pin and so as to increase the frictional contact of a tree stump and the point of ensconcement.

4. A stand of claim 3 wherein the second platform is provided with a plurality of concentric circular ribs and intersecting radial ribs, that enhance the degree of frictional contact of the tree stump and the irregular support surface provided by the rib configuration.

5. The stand of claim 1 wherein the material of stand fabrication is a thermoplastic resin selected from the group consisting of high impact polystyrene, high density polyethylene and polypropylene.

6. The stand of claim 5 wherein the upstanding pin comprises a pin subassembly having a flanged lower end which is encased in the resin of the molded body thereby underlying and anchoring the pin itself.

7. The stand of claim 1 wherein the lower peripheral rim of the external skirt lies in a substantially horizontal plane coincident with the planar surface of the bottom plate.

8. The stand of claim 1 wherein the rigid pin is tapered inwardly from the anchored lower longitudinal end to the upper longitudinal end thereof.

* * * * *